US008388191B2

(12) United States Patent
Hsieh

(10) Patent No.: US 8,388,191 B2
(45) Date of Patent: Mar. 5, 2013

(54) LED LAMP

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 195 days.

(21) Appl. No.: 13/053,354

(22) Filed: Mar. 22, 2011

(65) Prior Publication Data

US 2012/0243241 A1 Sep. 27, 2012

(51) Int. Cl.
*F21V 3/00* (2006.01)
*F21V 5/00* (2006.01)

(52) U.S. Cl. ..... 362/311.02; 362/249.02; 362/800

(58) Field of Classification Search ..... 362/249.02, 362/311.02, 800
See application file for complete search history.

(56) References Cited

U.S. PATENT DOCUMENTS

2011/0115373 A1* 5/2011 Plonski et al. ..... 315/35

* cited by examiner

*Primary Examiner* — Jason Moon Han
(74) *Attorney, Agent, or Firm* — John A. Fortkort; Fortkort & Houston P.C.

(57) ABSTRACT

A LED lamp includes: a base body having a screw thread; a light emitting unit including a printed circuit board disposed on the base body oppositely of the screw thread, and a LED chip disposed on the printed circuit board; and a heat sink body having a plurality of heat sink fins and connected threadedly to the screw thread.

5 Claims, 4 Drawing Sheets

LED LAMP

BACKGROUND OF THE INVENTION

1. Field of the Invention

This invention relates to a lamp, more particularly to a LED lamp.

2. Description of the Related Art

In recent years, with growing awareness in environmental protection consciousness and popularization of energy-saving and carbon-reduction concepts, a conventional lamp is being gradually replaced by a LED lamp since the LED lamp has relatively high light-emitting efficiency and relatively low energy consumption.

A conventional LED lamp is disclosed in Taiwan utility model No. M380442, and includes a light emitting unit having a plurality of LED chips, a lamp housing surrounding the light emitting unit, and a heat sink body connected to the light emitting unit and having a plurality of heat sink fins.

The lamp housing and the light emitting unit are fastened to the heat sink body using a plurality of screws in such a manner that the lamp housing and the heat sink body are respectively disposed at two opposite sides of the light emitting unit. Thus, when the light emitting unit is assembled with or disassembled from the lamp housing and the heat sink body, an auxiliary tool is necessary. Accordingly, the assembling and disassembling operations of the light emitting unit are time-consuming and inconvenient.

SUMMARY OF THE INVENTION

Therefore, an object of the present invention is to provide a LED lamp that can overcome the aforesaid drawbacks associated with the prior art.

Accordingly, a LED lamp according to this invention comprises:

a base body having a screw thread;

a light emitting unit including a printed circuit board disposed on the base body oppositely of the screw thread, and a LED chip disposed on the printed circuit board; and a heat sink body having a plurality of heat sink fins and connected threadedly to the screw thread.

BRIEF DESCRIPTION OF THE DRAWINGS

Other features and advantages of the present invent ion will become apparent in the fol lowing detailed description of the preferred embodiment of the invention, with reference to the accompanying drawings, in which.

DETAILED DESCRIPTION OF THE PREFERRED EMBODIMENT

Figure 1:
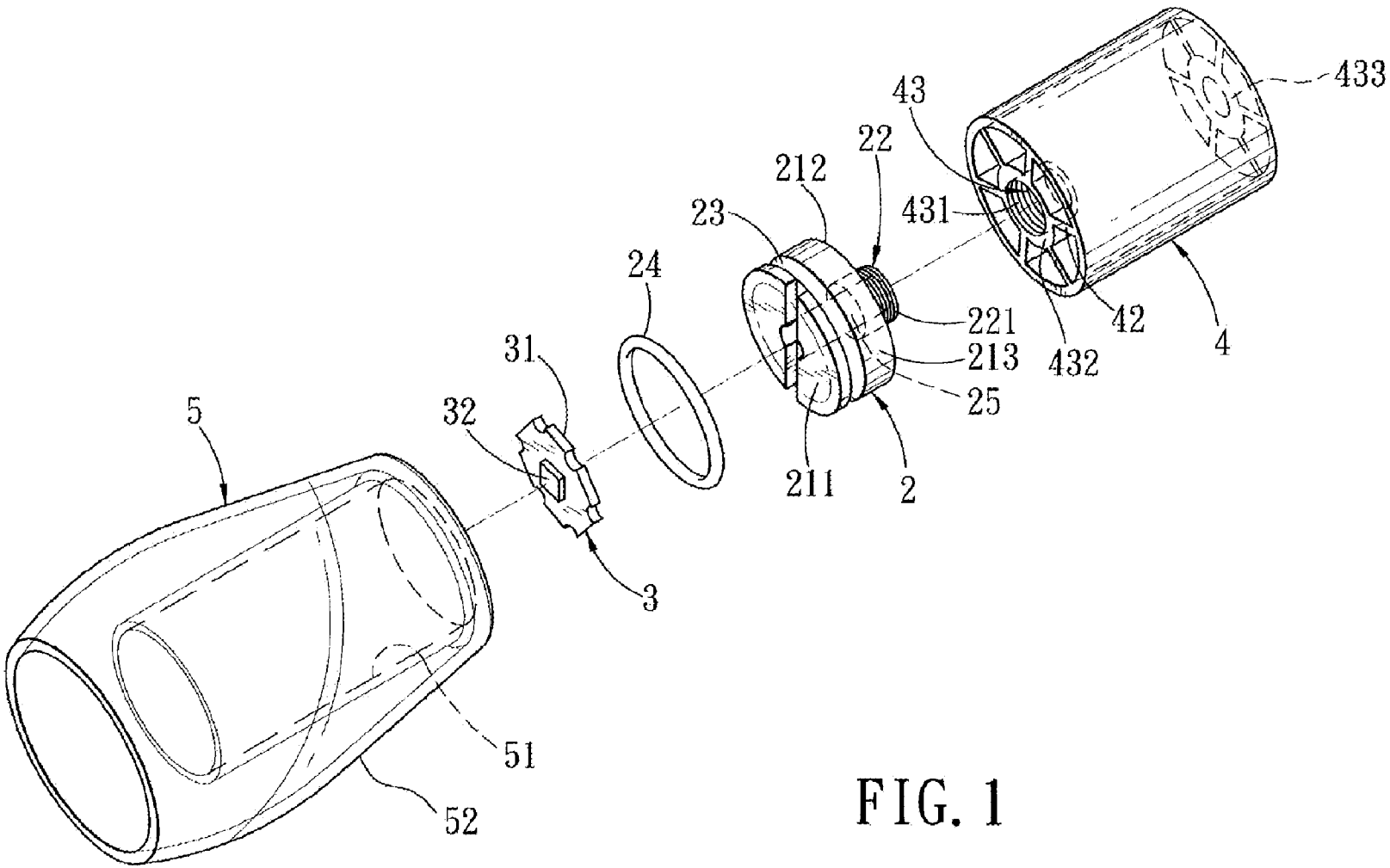
FIG. 1 is an exploded perspective view of the preferred embodiment of a LED lamp according to the present invention.
Figure 2:
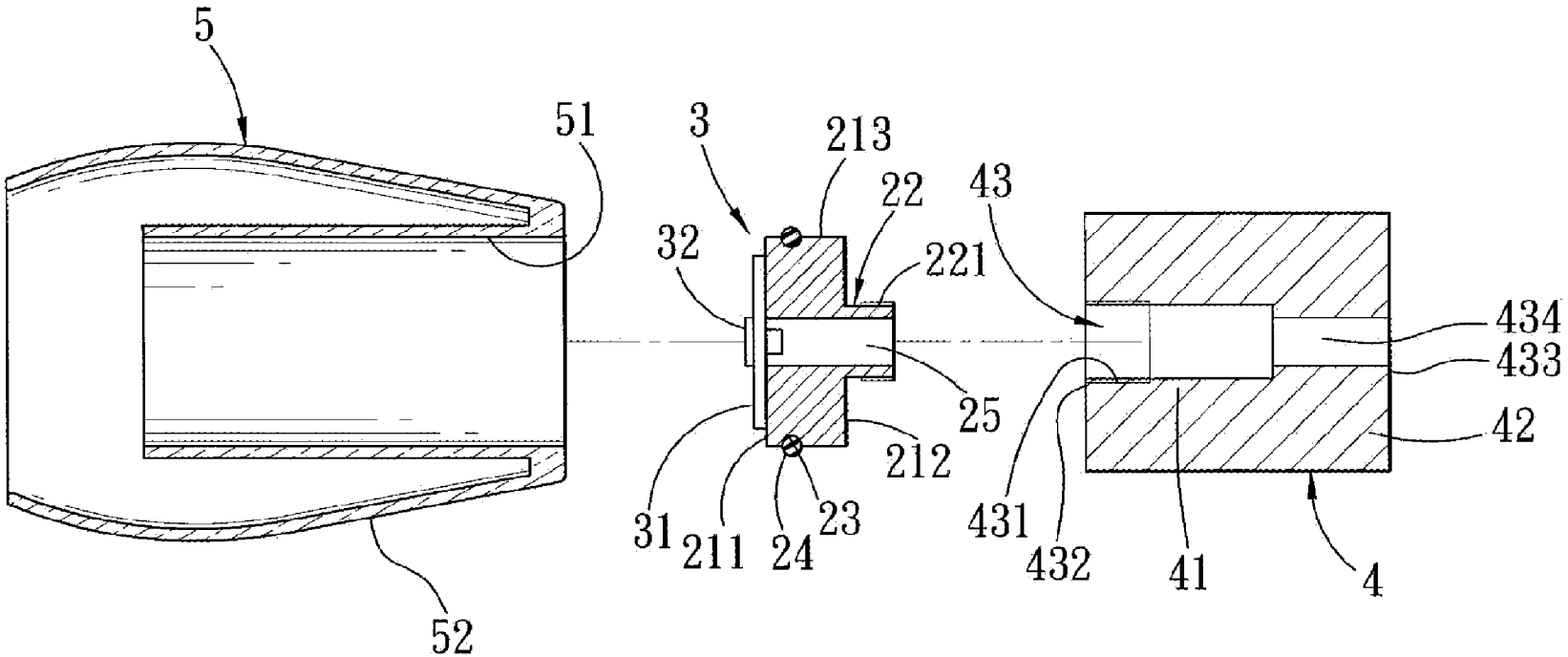
FIG. 2 is an exploded cross-sectional view of the preferred embodiment of the LED lamp shown in FIG. 1.

Referring to FIGS. 1 and 2, the preferred embodiment of a LED lamp according to the present invention comprises a base body 2, a light emitting unit 3, a heat sink body 4, and a lamp housing 5.

The base body 2 is made of a thermal conductive metal (such as copper), and includes: an upper surface 211 supporting the light emitting unit 3, a lower surface 212 opposite to the upper surface 211, a protrusion 22, an annular recess 23, a screw thread 221, and a resilient ring 24. The protrusion 22 protrudes from the lower surface 212. The annular recess 23 is indented from an annular outer surface 213 of the base body 2 between the upper and lower surfaces 211, 212. The screw thread 221 is a male thread formed around the protrusion 22. The resilient ring 24 is fitted in the annular recess 23 and protrudes from the annular outer surface 213. Preferably, the base body 2 further has a through hole 25 extending through the upper and lower surfaces 211, 212 and the protrusion 22.

The light emitting unit 3 includes a printed circuit board 31 disposed on the upper surface 211 of the base body 2 oppositely of the screw thread 221, and a LED chip 32 disposed on the printed circuit board 31.

The heat sink body 4 is also made of a thermal conductive metal (such as copper), and is connected threadedly to the screw thread 221. The heat sink body 4 includes a central post 43 formed with a female thread 431 to engage the screw thread 221, a housing wall 41 surrounding the central post 43, and a plurality of heat sink fins 42 extending from the central post 43 to the housing wall 41. It should be noted that, since the housing wall 41 encloses the heat sink fins 42, the LED lamp of this invention exhibits better appearance than the conventional LED lamp having the exposed heat sink fins.

As best shown in FIG. 2, the central post 43 has top and bottom ends 432, 433, and a central slot 434. The central slot 434 extends through the top and bottom ends 432, 433, is formed with the female thread 431, and is communicated spatially with the through hole 25 of the base body 2. The through hole 25 and the central slot 434 are advantageous for heat dissipation of an electric wire (not shown) passing therethrough.

When the base body 2, the light emitting unit 3, and the heat sink body 4 are combined together, the heat generated from the LED chip 32 can be dissipated through the base body 2 and the heat sink body 4.

The lamp housing 5 is disposed around the base body 2, and has an inner surrounding wall 51 and an outer surrounding wall 52. The inner surrounding wall 51 surrounds the base body 2 and engages the resilient ring 24. The outer surrounding wall 52 surrounds the inner surrounding wall 51.

Although, in the preferred embodiment, the base body 2 has the male screw thread 221 engaged to the female thread 431 of the heat sink body 4, the engaging structure between the base body 2 and the heat sink body 4 should not be limited to this embodiment. For example, the heat sink body 4 may include a protrusion having a male thread (not shown) to engage to a female thread of a recess (not shown) indented from the lower surface 212 of the base body 2.

Figure 3:
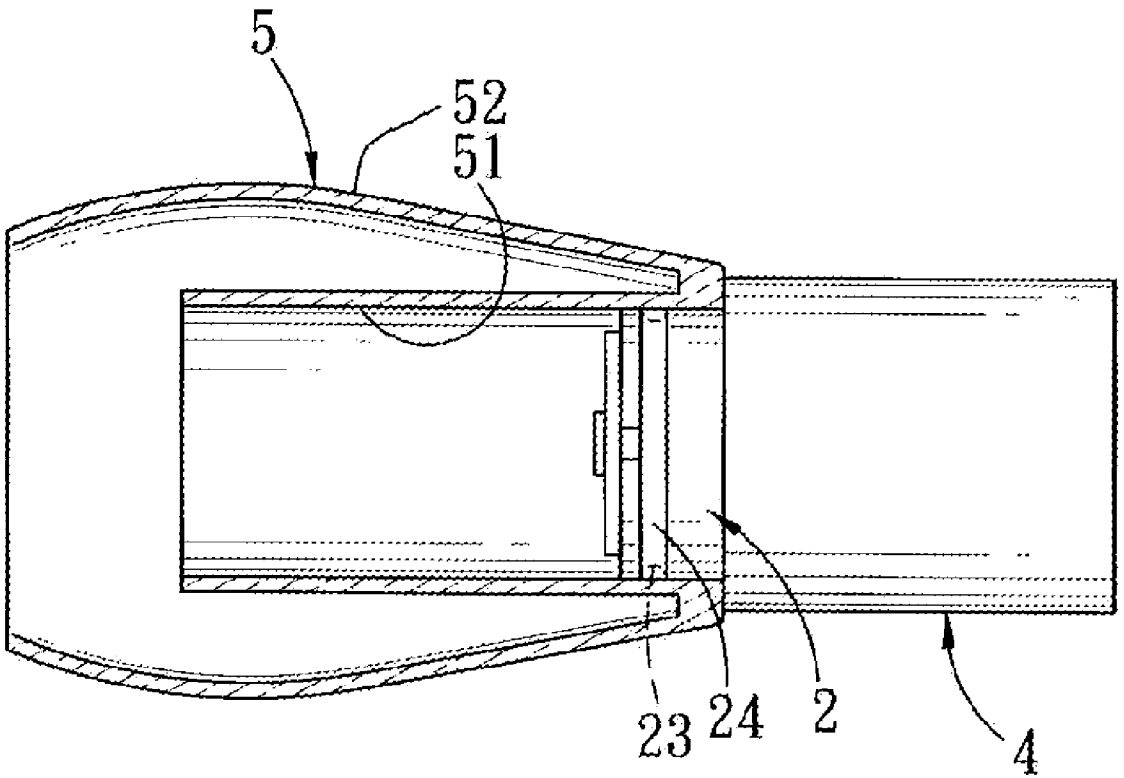
FIG. 3 is a partially sectioned view of the preferred embodiment of the LED lamp of FIG. 1 in an assembled state.
Figure 4:
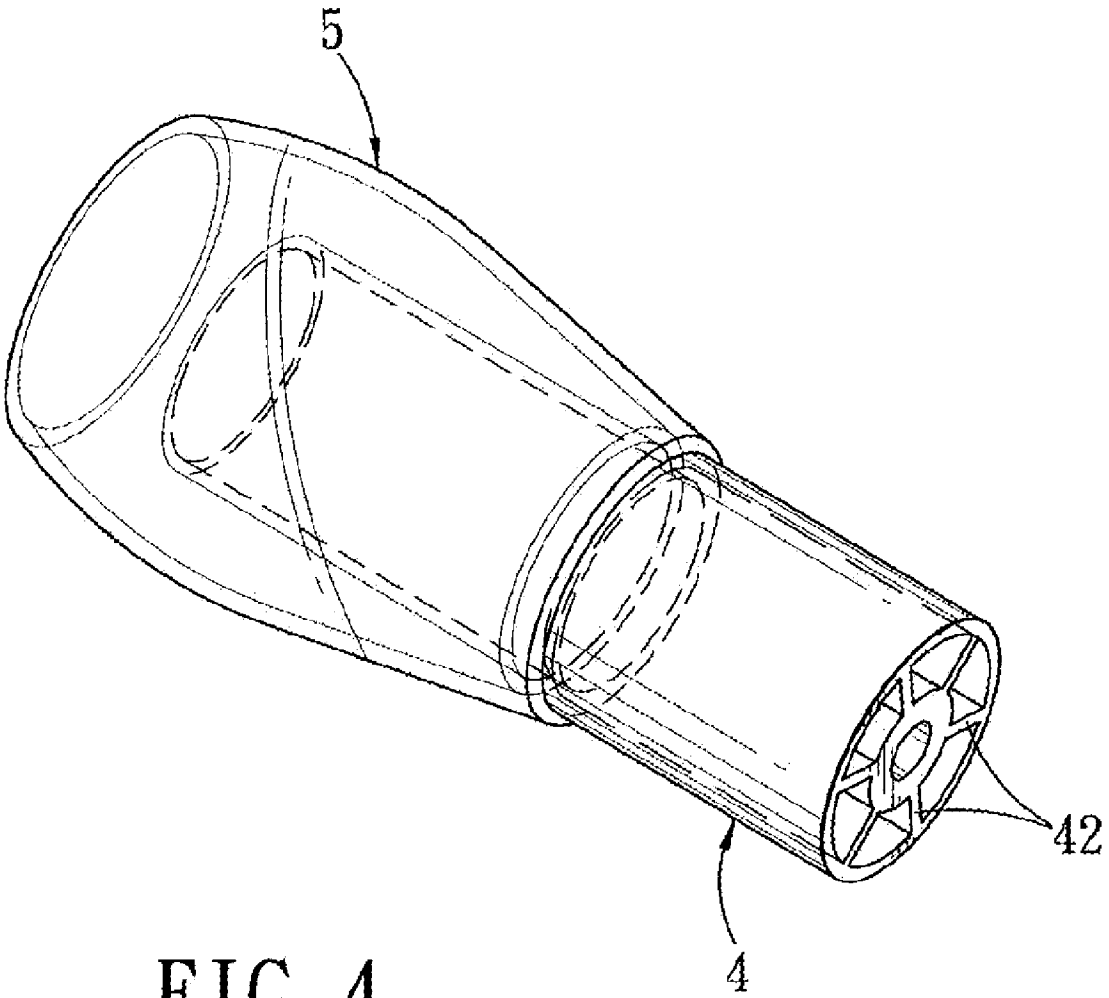
FIG. 4 is a perspective view of the preferred embodiment of the LED lamp of FIG. 1 in an assembled state.

Referring to FIGS. 2 to 4, when installing the LED lamp of this invention, it can be easily achieved by threadedly connecting the male thread of the base body 2 to the female thread 431 of the heat sink body 4, followed by disposing the inner surrounding wall 51 of the lamp housing 5 around the base body 2 to engage the resilient ring 24, without requiring an auxiliary tool.

Furthermore, the lamp housing 5 may be modified to have various appearances according to users' requirements, as long as the inner surrounding wall 51 can engage the resilient ring 24.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A LED lamp, comprising:

a base body having a screw thread;

a light emitting unit including a printed circuit board disposed on said base body oppositely of said screw thread, and a LED chip disposed on said printed circuit board;

a heat sink body having a plurality of heat sink fins and connected to said screw thread; and a lamp housing, said base body further including an annular recess indented from an annular outer surface of said base body between said upper and lower surfaces, and a resilient ring fitted in said annular recess and protruding from said annular outer surface of said base body, said lamp housing being disposed around said base body and engaging said resilient ring.

2. The LED lamp of claim 1, wherein said base body further has an upper surface supporting said light emitting unit, a lower surface, and a protrusion protruded from said lower surface, said screw thread being a male thread formed around said protrusion, said heat sink body being formed with a female thread to engage said male thread.

3. The LED lamp of claim 1, wherein said lamp housing further has an inner surrounding wall surrounding said base body and engaging said resilient ring, and an outer surrounding wall surrounding said inner surrounding wall.

4. The LED lamp of claim 2, wherein said heat sink body further includes a central post formed with said female thread, and a housing wall surrounding said central post, said heat sink fins extending from said central post to said housing wall.

5. The LED lamp of claim 4, wherein said base body further has a through hole extending through said upper and lower surfaces and said protrusion, said central post having top and bottom ends, and a central slot extending through said top and bottom ends and formed with said female thread, said central slot being communicated spatially with said through hole of said base body.

* * * * *